US006425985B1

(12) United States Patent
Hagfors et al.

(10) Patent No.: US 6,425,985 B1
(45) Date of Patent: Jul. 30, 2002

(54) METHOD OF MANUFACTURING PRESS FELT, AND PRESS FELT

(75) Inventors: Satu Hagfors, Ylöjärvi; Jukka Huhtiniemi, Tampere, both of (FI)

(73) Assignee: Tamfelt OYJ ABP, Tampere (FI)

( * ) Notice: Subject to any disclaimer, the term of this patent is extended or adjusted under 35 U.S.C. 154(b) by 0 days.

(21) Appl. No.: 09/719,099

(22) PCT Filed: Jun. 9, 1999

(86) PCT No.: PCT/FI99/00504

§ 371 (c)(1),
(2), (4) Date: Dec. 8, 2000

(87) PCT Pub. No.: WO99/64670

PCT Pub. Date: Dec. 16, 1999

(30) Foreign Application Priority Data

Jun. 10, 1998 (FI) ..... 981335

(51) Int. Cl.[7] ..... D21F 7/08

(52) U.S. Cl. ..... 162/358.2; 162/900; 442/183; 442/189; 442/274; 442/288

(58) Field of Search ..... 162/306, 358.1, 162/358.2, 358.3, 358.4, 358.5, 359.1, 361, 900, 901, 902; 139/383 A, 383 AA; 428/221; 442/181, 183, 197, 198, 199, 268, 270, 274, 286, 288, 301, 414, 189; 28/100, 110

(56) References Cited

U.S. PATENT DOCUMENTS

| | | | | | |
|---|---|---|---|---|---|
| 3,401,467 | A | | 9/1968 | Koester | 34/95 |
| 3,458,911 | A | * | 8/1969 | Koester | 28/110 |
| 4,382,987 | A | * | 5/1983 | Smart | 428/212 |
| 4,482,601 | A | | 11/1984 | Hartigan, Jr. | 442/274 |
| 4,537,816 | A | | 8/1985 | Booth et al. | 442/206 |
| 4,657,806 | A | * | 4/1987 | Dutt | 442/76 |
| 4,781,967 | A | | 11/1988 | Legge et al. | 428/109 |
| 4,882,217 | A | * | 11/1989 | FitzPatrick | 428/212 |
| 5,087,327 | A | * | 2/1992 | Hood | 162/358.2 |
| 5,204,150 | A | | 4/1993 | Davenport | 428/58 |
| 5,204,171 | A | * | 4/1993 | Eschmann | 442/195 |
| 5,391,419 | A | | 2/1995 | Davenport | 428/193 |
| 5,629,052 | A | | 5/1997 | Trokhan et al. | 427/508 |
| 5,732,749 | A | | 3/1998 | Fargeout | 139/383 AA |

FOREIGN PATENT DOCUMENTS

| | | | |
|---|---|---|---|
| FI | 92848 | 1/1995 | |
| FI | 104338 | 12/1999 | D21F/7/08 |

OTHER PUBLICATIONS

Office Action in Finish Patent Application No. 981335.

* cited by examiner

*Primary Examiner*—Peter Chin
*Assistant Examiner*—Eric Hug
(74) *Attorney, Agent, or Firm*—McDermott, Will & Emery

(57) ABSTRACT

The invention relates to a method of manufacturing a press felt, according to which method a press felt is manufactured which has a good initial density by means a water soluble material, such as polymer, preferably polyvinyl alcohol (PVAL), applied to the texture of the press felt. Furthermore, the invention relates to a press felt comprising a body (2) and a crill layer (1) arranged thereto. Furthermore, the press felt comprises a portion of a water soluble material, such as water soluble polymer, arranged to dissolve from the texture after the initial density obtained by means of it is no longer needed.

16 Claims, 2 Drawing Sheets

METHOD OF MANUFACTURING PRESS FELT, AND PRESS FELT

BACKGROUND OF THE INVENTION

1. Technical Field

The invention relates to a method of manufacturing a press felt, in which method a press felt is formed which comprises a body composed of several threads in the transverse direction and in the longitudinal direction and in order to provide a smooth surface with good water retention capacity, a crill layer is needled at least on the surface of the body facing the web to be dried.

The invention further relates to a press felt comprising a body formed of several threads in the longitudinal direction and in the transverse direction, and a crill layer is arranged at least on the surface of the body facing the web to be dried.

2. Description of the Related Art

A press felt is used in presses of paper machines either on one side or on both sides of the web to be dried, depending on the method to be each time applied. Water in the web penetrates the press felt at a compression stage and after the compression the press felt should carry the water without letting it transfer back to the web. In other words, during the compression the paper web is transported on the felt into a slot between two rolls, i.e. into a press roll nip. Typically there are three or four such nips in a row and in each of them water is squeezed out of the web to the felt. In other words, the felt has to be such that the water can easily pass onto the felt compressed in the press roll nip. Prior art press felts comprise a body, i.e. a body texture, providing the press felt with space for water. In addition thereto, crill has been needled to the press felt, the crill providing the desired smoothness of the felt surface and water retention capacity of the felt. In other words, an essential function of the crill is, in addition to marking, to prevent water from transferring back from the felt to the web. The body texture is typically woven. The weaving of the body texture is somewhat slow and costly, for which reason non-woven textures have been developed. U.S. Pat. No. 4,781,967 discloses a multi-layer press felt with a texture comprising non-woven thread arrangements joined crosswise with a smeltable fiber or with glue, the thread arrangements being composed of interlocked modules formed of parallel threads and crill. However, the texture of such a felt is somewhat dense because of the glue or the layer to be melted, used for attaching the threads and crill.

The press felt should be dense enough at the very outset so that the paper machine could be started up rapidly. The most common way to make the press felt dense is to needle fine crill on one or several layers of the felt. The density of the press felt can also be influenced by arranging in the texture a separate compact layer or by making use of a dense texture produced by the bonding texture and/or the shape of the threads. However, such solutions do not function satisfactorily during operation after the start-up, and the dense press felt becomes clogged fast and its operating life remains too short. A short operating life adds to the number of maintenance shutdowns of the paper machine and therefore disturbs the actual production. It is therefore a problem of too dense a press felt that its texture becomes clogged fast, whereby its dewatering capacity and, at the same time, the efficiency of the entire press section become dramatically low. A more loose-textured press felt would, on the other hand, lead to reduced clogging and a sufficiently long operating life of the felt, but, unfortunately, at the same time to a slow paper machine start-up. Such a loose-textured press felt has to be run free of load in the paper machine before the actual production run as long as it has settled and become compressed to provide the desired dewatering properties. If the felt contains too much space for the air carried along and if the liquid transferred onto the felt has space to move, by the impact of compression, to the interior of the felt and not to the grooves or openings of the press roll, dewatering in the nip does not take place in the desired manner. It has also been observed that prior art press felts tend to compress and thereby become excessively dense along with use whereupon they become clogged and their dewatering capacity is reduced.

SUMMARY OF THE INVENTION

An object of the present invention is thus to provide a method of manufacturing a new type of press felt, and a press felt with good properties at the very outset of the start up of the paper machine and yet with a sufficiently long operating life attainable.

The method of the invention is characterized in that the press felt is formed in a manner such that during the manufacture of the press felt the texture of the press felt is provided with a portion of a water soluble material which initially makes the texture of the yet uncompressed press felt dense at least for the duration of the start-up of a press section so as to provide the desired dewatering properties, and that at least part of said water soluble material washes away and/or is washed off after the start-up as the initial density provided by the water soluble material is no longer needed, because the texture of the press felt has become dense by the impact of compression.

The press felt of the invention is further characterized in that the texture of the press felt comprises a portion of a water soluble material arranged to provide the desired permeability for the yet uncompressed press felt, and that the press felt is arranged to be installed in a paper machine in a manner such that when being installed, the press felt comprises a portion of said water soluble material arranged to wash away and/or be washed off from the texture of the press felt at least partly later on during the operation of the paper machine as the initial density provided by the water soluble material is no longer needed, because the texture of the press felt has become dense by the impact of compression.

An essential idea of the invention is that the texture of the press felt comprises a water soluble material which makes the texture of the press felt dense for the start-up so that the paper machine can be rapidly made ready for production run after the change of the press felt. It is a further idea that a sufficiently long press felt life can be obtained from the point of view of effective production as the material that makes the press felt dense dissolves gradually and prevents the risk of clogging after the paper machine is restarted after the change of the felt. By the time part of the water soluble material is dissolved from the texture of the felt, the press felt has taken shape, become compressed and changed its properties to reach the desired dewatering properties. The water soluble material is preferably polymer, but other water soluble materials suitable for the purpose can also be used. An essential idea of a preferred embodiment of the invention is that the body is not woven, but it is a texture which is interlocked with thread arrangements bound with the water soluble polymer and to which texture crill is needled. The needling of the crill binds the layers definitively, so that they will hold together even after the water soluble material keeping together the threads of the body before the needling of the crill is substantially entirely dissolved from the texture of the press felt.

An advantage of the invention is that a compromise is no longer needed be made between a rapid start-up capacity and long operating life of the press felt, but the two preferred features can be satisfactorily achieved by the solution of the invention. Such a press felt is of course considerably more effective than the former ones, since it enables the paper machine to be rapidly made ready for production run after the change of the felt and still functions effectively for the normal change interval planned. Consequently, production is no longer disturbed by extra machine shutdowns caused by the change of the press felt. An advantage of the embodiment according to which the body is formed of non-woven thread arrangements is that slow and costly weaving can now be avoided and the body can be manufactured more cost effectively, rapidly and flexibly than before.

BRIEF DESCRIPTION OF THE DRAWINGS

In the following, the invention will be described in more detail by means of the accompanying drawings, in which FIG. 1 schematically shows a sectional view of a press felt of the invention, seen from a direction transverse to the direction of travel of the felt, FIG. 2 schematically shows a sectional view of a second press felt of the invention, seen from a direction transverse to the direction of travel of the felt, FIG. 3 schematically shows a perspective sectional view of a third press felt of the invention, and FIG. 4 schematically shows a sectional view of yet another potential press felt according to the inventive idea.

DETAILED DESCRIPTION OF THE PREFERRED EMBODIMENTS

Figure 1:
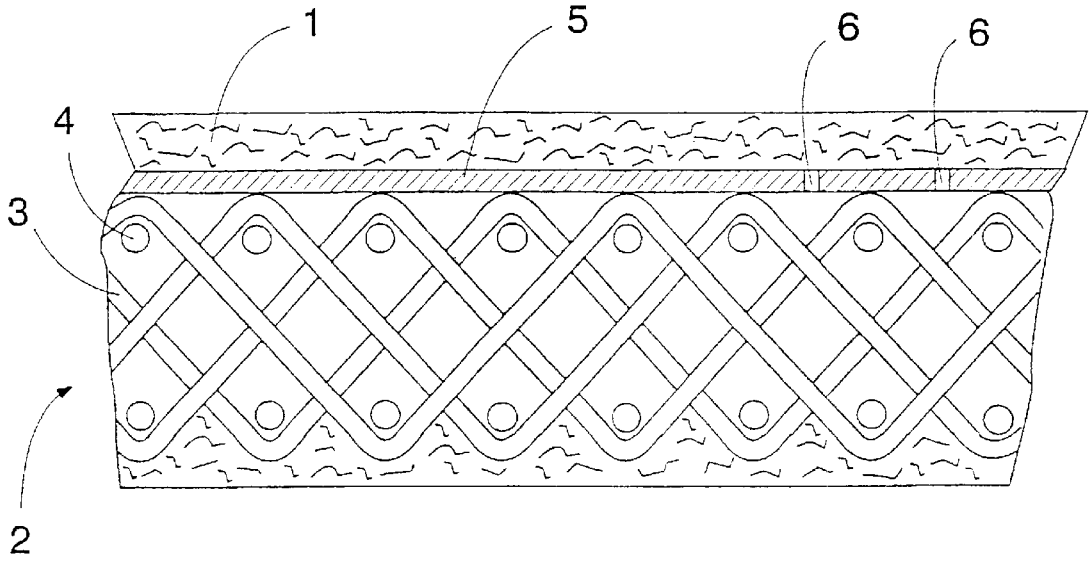

FIG. 1 shows a strongly simplified sectional view of a potential texture of a press felt of the invention. The press felt of the figure comprises three interlinked layers, of which the uppermost layer is in this case a crill layer 1 arranged on the side facing a web to be dried, which crill prevents marking from being produced on the surface of the paper web. Such a crill layer is typically composed of at least two thinner layers to be needled separately one on the other. The lowermost layer of the press felt may also be crill in the manner shown in the figure. Furthermore, the press felt comprises a body 2 made of threads 3 and 4 by weaving. The texture of the body is conventionally somewhat loose. The density of the body 2 has to be such that the the desired looseness and dewatering properties can be attained in a nip. A film 5 made of water soluble polymer, such as polyvinyl alcohol (PVAL), is arranged between the crill layer 1 and the body 2 of the middle section. The film keeps the texture dense until it is either entirely or partly washed off from the texture. The film making the texture dense may comprise apertures 6, or it can be a compact solid layer. Furthermore, such a film may be a PVAL fiber layer or a PVAL gauze layer and it can also be arranged elsewhere in the texture of the press felt. Thickness, location in the texture and other properties of the film can be chosen after the desired dewatering and other properties have been taken into account. Before installation in the paper machine, a press felt like this is preferably washed so that some of the polymer providing the density is washed off, leaving the felt advantageously dense for the start-up. The rest of the polymer in the texture of the felt is dissolved during the running of a press section. The above pre-wash is not always required as the press felt may be ready provided with necessary initial density.

Water soluble polymers that can be applied to the textures of the invention of FIG. 1 and also to those presented later include, in addition to PVAL, i.e. polyvinyl alcohol, polyethylene oxide, calcium alginate, soft acrylate and hydroxymethylcellulose. Polyvinyl alcohol especially having a quality of easily dissolving in fairly cold water is preferably used as the water soluble polymer. PVAL types previously used in textile industry and paper industry dissolve easily only in relatively hot water having a temperature above 60° C. Such PVAL types dissolving in hot water cannot be successively used in press felts, since they form a sticky and jelly layer in the texture as they dissolve. Dirt is accumulated in this layer, the outcome of which being that the press felt has to be changed earlier than planned. In contrast, new types of PVAL, whose degree of hydrolysis is preferably between 87% and 89% and the degree of polymerization is preferably between 500 and 2500, can be preferably used in accordance with the invention as a temporary compressing material of the press felts and as a binding material of non-woven textures. Thanks to its degree of hydrolysis such PVAL is well soluble even in water having a temperature as low as about 5° C. PVAL which dissolves well in water having a temperature below 40° C. is preferably used in press felts, since the temperature of white-water in paper machines is normally about 40° C. Furthermore, an advantage of the use of PVAL is its reasonable price.

Figure 2:
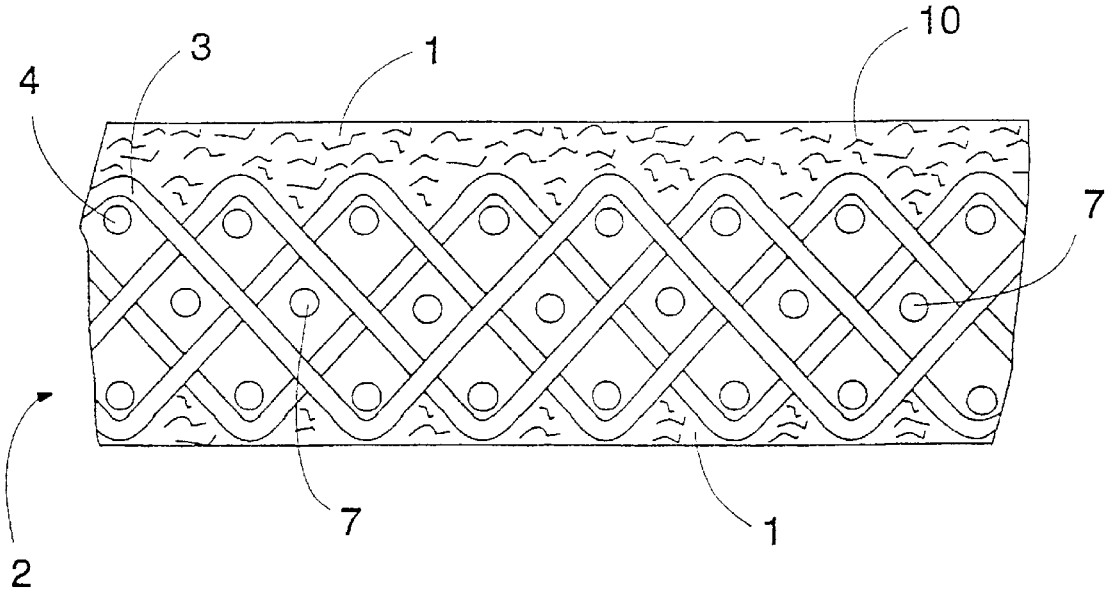

FIG. 2 shows a simplified cross-sectional view of a second structure of a press felt of the invention seen from a direction transverse to the direction of the travel of the felt. In the case of the figure the density of the felt has been achieved by arranging in the body 2 of the texture threads 7 made of PVAL or a corresponding material. Some of the threads parallel with the threads 3 and 4 may be made of PVAL. The polymer thread, which makes the felt dense, dissolves from the felt texture gradually, and the initially dense felt gradually becomes more loose. By changing the quality and amount of the polymer fiber and the texture of the polymer fiber bonding formed thereof, the efficiency and duration of the density can be adjusted as desired. Furthermore, it is possible to arrange water soluble polymer fiber 10 in the crill layer 1. The texture can be so arranged that substantially all water soluble polymer is dissolved from the felt when the felt has advantageously settled from the point of view of the press section by the impact of the run up to then. Furthermore, the felt press of the invention can be pre-washed by the manufacturer of the felt so that when the press felt is being installed in the paper machine, it is ready provided with exactly the appropriate density. In other words, some of the water soluble polymer provided in the texture of the press felt can be washed off beforehand either when the felt is conventionally washed after manufacture or in connection with washing carried out particularly for the purpose of removing the polymer. This also enables the manufacture of press felts with standard density, which press felts can then be pre-treated by having them washed by the manufacturer to provide the initial density required by each paper machine and paper manufacturer.

Furthermore, various differently soluble polymers can be used in the texture of the press felt, and by washing them off in a given manner the press felt can be provided with the desired properties. In that case at least in principie it is possible to use in the press felt for example two types of PVAL which dissolve at different temperatures and to selectively wash off the desired PVAL or the desired amount of PVAL by raising the washing temperature stepwise. This means that one PVAL type essential to the manufacture of the felt can be washed off from the finished press felt at the end of manufacture and, correspondingly, the other PVAL type affecting the density can be left to be washed off in the paper machine.

Figure 3:
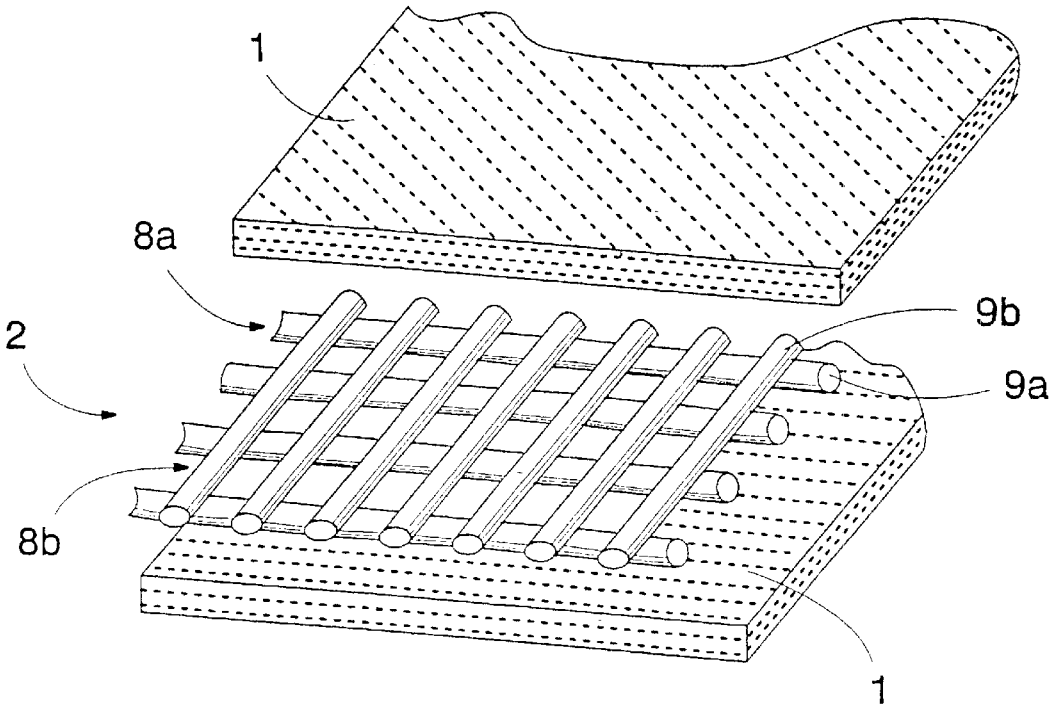

FIG. 3 shows a preferred way of how to form a press felt of the invention. The body of the press felt of the figure is not woven, but it is formed of thread arrangements 8*a* and 8*b* arranged crosswise either perpendicularly or at a desired angle with respect to one another. Although the body of the figure is composed of two thread arrangements, it is obvious that it can also be composed of one thread arrangement only or of more than two thread arrangements. The thread arrangement, i.e. a row composed of parallel and interlocked threads 9*a*, 9*b*, is formed by using water soluble polymer for binding the threads. The above-described PVAL which dissolves in cold water is preferably used for joining together thread arrangements like this, but other suitable water soluble polymers enabling the threads to be glued can also come into question. In the thread arrangements, parallel, preferably either single or double, monofilaments can be used. Multifilaments and tufts can also be applied. The film joining the adjacent threads into a thread arrangement can be preferably formed by applying PVAL around the threads, the PVAL forming a combining layer between the adjacent threads as it comes into contact with water or other polar dissolvent, heat, pressure or a combination of some of these. In addition to fiber and thread, PVAL in the form of powder, ribbon, granule, gauze and/or non-woven fabric can be used in the formation of the layer. The layer joining the threads together can be formed either by means of PVAL contained in the threads, by means of separately applied PVAL or by a combination thereof.

Figure 4:
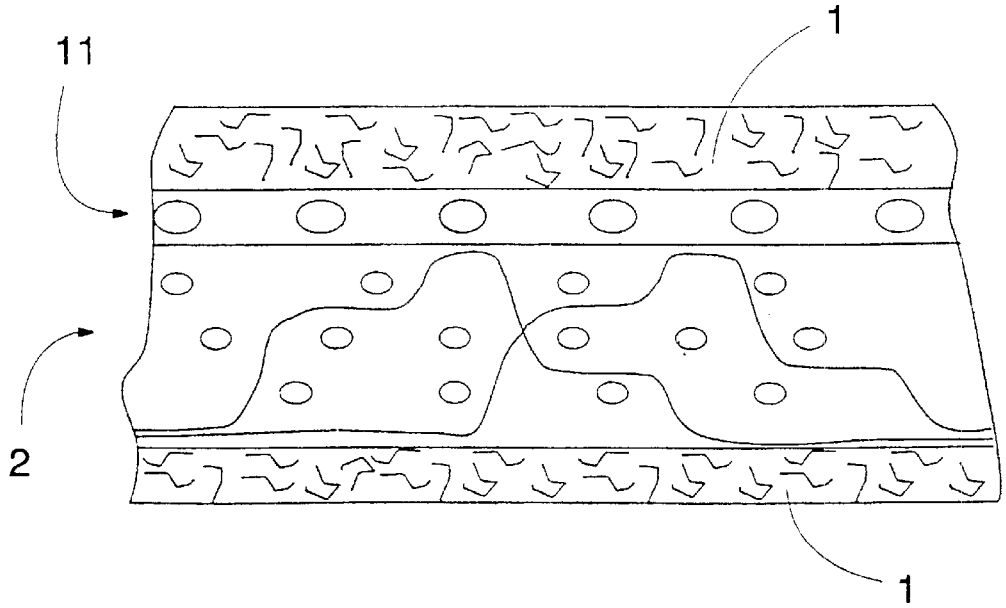

FIG. 4 shows a simplified sectional view of yet another potential structure of a press felt of the invention. The outermost layers are in a conventional manner crill layers 1 and a layer 11 in the upper part of the figure between the crill layers is formed of non-woven threads and water soluble polymer. Furthermore, the actual conventional woven body texture 2 is arranged between the layer which makes the press felt dense and the lower crill layer.

The drawings and the related description are only intended to illustrate the idea of the invention. Details of the invention may vary within the scope of the claims. Thanks to the arrangement of the invention the two contrasting features, the dense texture and the loose texture, can be timed well. The press felt is provided with the desired properties from the very beginning by means of a water soluble material, which is preferably water soluble polymer. The aim is to provide a press felt with a stabile density for the whole operating life. The press felt is preferably provided with a layer of PVAL or the like in a manner so that the layer dissolves in proportion as the texture becomes clogged because of impurities or density caused by the compression of the texture of the press felt. In this way the felt is substantially provided with standard density for the duration of production. If desired, an extreme initial density can be arranged by means of an additional PVAL type. It should be still mentioned that it is possible to combine the solutions presented in the figures in a suitable manner for the purpose of compressing so as to form the desired texture. Special washers can also be arranged in connection with the paper machine, enabling the polymer providing the properties of the invention to be washed off extremely rapidly, if desired. Such an arrangement can be utilized when it is detected by means of measurements, for example, that the felt has adapted to the paper machine, and the density created by means of the polymer is therefore no longer needed. In that case, substantially all the water soluble polymer can be washed off from the felt by an effective press felt washer and thereby a more loose press felt can be obtained which does not become clogged fast and which is able to retain its dewatering capacity longer.

What is claimed is:

1. A press felt comprising:

a body formed of a plurality of threads arranged in a longitudinal direction and in a transverse direction, and a crill layer arranged at least on the surface of the body facing the web to be dried, wherein a texture of the press felt comprises a portion of a water soluble material arranged to provide a desired permeability for the yet uncompressed press felt, and wherein the press felt is arranged to be installed in a paper machine in a manner such that when being installed, the press felt comprises a portion of said water soluble material arranged to wash away or be washed off from the texture of the press felt at least partly later on during the operation of the paper machine as the initial density provided by the water soluble material is no longer needed, because the texture of the press felt has become dense by the impact of compression, and the water soluble material dissolves in water of the paper machine.

2. The press felt of claim 1, wherein the water soluble material is water soluble polymer.

3. The press felt of claim 1, wherein the body is woven by using thread or fibers made of water soluble materials.

4. The press felt of claim 1, wherein the body comprises at least one layer of a non-woven thread arrangement which comprises parallel threads joined together by means of a layer formed of a water soluble material.

5. The press felt of claim 1, wherein the crill layer is provided with a water soluble fiber material.

6. The press felt of claim 1, wherein the press felt is pre-washed during manufacture so as to obtain the desired permeability.

7. The press felt of claim 2, wherein the water soluble polymer is polyvinyl alcohol (PVAL) which dissolves in water having a temperature below 40° C. and whose degree of hydrolysis is between 87% and 89% and degree of polymerization between 500 and 2500.

8. A press felt comprising:

a body formed of a plurality of threads arranged in a longitudinal direction and in a transverse direction, and a crill layer arranged at least on the surface of the body facing the web to be dried, wherein a texture of the press felt comprises a foil which makes the press felt dense and is made of a water soluble material arranged to provide a desired permeability for the yet uncompressed press felt, and wherein the press felt is arranged to be installed in a paper machine in a manner such that when being installed, the press felt comprises a portion of said water soluble material arranged to wash away or be washed off from the texture of the press felt at least partly later on during the operation of the paper machine as the initial density provided by the water soluble material is no longer needed, because the texture of the press felt has become dense by the impact of compression.

9. A method of manufacturing a press felt including a body composed of a plurality of threads in the transverse direction and in the longitudinal direction and a crill layer needled at least on the surface of the body facing a web to be dried in order to provide a smooth surface with good water retention capacity, the method comprising the steps:

providing the press felt with a portion of a water soluble material which initially makes the texture of the yet uncompressed felt dense at least for the duration of the start-up of a press section so as to provide desired dewatering properties, and washing away at least part of said water soluble material with water of the press section after the start-up as the initial density provided by the water soluble material is no longer needed and the texture of the press felt has become dense by the impact of compression.

10. The method of claim 9, wherein a water soluble polymer is used as the water soluble material.

11. The method of claim 9, wherein the body is woven by using thread or fiber made of a water soluble material.

12. The method of claim 9, further comprising a step of forming a non-woven layer which comprises at least in one layer parallel threads joined together by a water soluble material.

13. The method of claim 9, wherein the crill layer is provided with fiber made of a water soluble material.

14. The method of claim 9, wherein the water soluble material initially arranged as a structural part of the press felt is washed off during manufacture so as to provide the desired permeability for the press felt that is to be attached to a press section.

15. The method of claim 10, wherein the water soluble polymer is polyvinyl alcohol (PVAL) which dissolves in water having a temperature below 40° C. and whose degree of hydrolysis is between 87% and 89% and degree of polymerization is between 500 and 2500.

16. A method of manufacturing a press felt including a body composed of a plurality of threads in the transverse direction and in the longitudinal direction and a crill layer needled at least on the surface of the body facing a web to be dried in order to provide a smooth surface with good water retention capacity, the method comprising the steps:

providing the texture of the press felt with a film made of a water soluble material which initially makes the texture of the yet uncompressed felt dense at least for the duration of the start-up of a press section so as to provide desired dewatering properties, and washing away at least part of said water soluble material after the start-up as the initial density provided by the water soluble material is no longer needed and the texture of the press felt has become dense by the impact of compression.

* * * * *